US006229426B1

(12) United States Patent
Lavado et al.

(10) Patent No.: US 6,229,426 B1
(45) Date of Patent: May 8, 2001

(54) CIRCUIT BREAKER HAVING SELECTED AMBIENT TEMPERATURE SENSITIVITY

(75) Inventors: Michael J. Lavado, Chepachet, RI (US); Nathaniel Wicks, Somerville; Peter G. Berg, Attleboro Falls, both of MA (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 09/426,650

(22) Filed: Oct. 25, 1999

(51) Int. Cl.[7] ..... H01H 71/16; H01H 33/30; H01H 9/30

(52) U.S. Cl. ..... 337/57; 337/319; 337/96; 337/50; 337/66; 337/74; 218/117

(58) Field of Search ..... 337/319, 42, 43, 337/45–48, 50, 66, 67, 70, 68, 69, 71–75, 57, 62; 218/1, 151; 20/61.19, 506

(56) References Cited

U.S. PATENT DOCUMENTS

| | | | | |
|---|---|---|---|---|
| 3,361,882 | | 1/1968 | Clarke . | |
| 3,686,602 | * | 8/1972 | Jullien-Davin | 337/66 |
| 3,792,403 | * | 2/1974 | Bullock | 337/66 |
| 4,024,487 | * | 5/1977 | Krasser et al. | 337/46 |
| 4,400,677 | * | 8/1983 | Cobb, III et al. | 337/6 |
| 4,780,697 | * | 10/1988 | Cobb, III et al. | 337/70 |
| 4,812,799 | * | 3/1989 | Cobb, III et al. | 337/70 |
| 4,827,233 | * | 5/1989 | Cobb, III | 335/201 |
| 4,837,545 | * | 6/1989 | Cobb, III et al. | 337/66 |
| 4,939,495 | * | 7/1990 | Peterson et al. | 337/79 |
| 4,990,882 | * | 2/1991 | Peter | 337/66 |
| 6,084,193 | * | 7/2000 | Pellon | 218/117 |

FOREIGN PATENT DOCUMENTS

| | | | | |
|---|---|---|---|---|
| 3400286 | * | 7/1985 | (DE) | H01H/73/30 |
| 0285340 | * | 10/1988 | (EP) | H01H/73/30 |

* cited by examiner

*Primary Examiner*—Leo P. Picard
*Assistant Examiner*—Anatoly Vortman
(74) *Attorney, Agent, or Firm*—Russell E. Baumann; Frederick J. Telecky, Jr.

(57) ABSTRACT

A circuit breaker (10) is shown having a movable electrical contact (36) adapted to move into and out of engagement with a stationary electrical contact (38, 40). A current carrying thermostatic trip member (42) has a portion movable in response to changes in temperature with a motion transfer member (46) transferring the motion to latch/catch mechanism (20, 24, 30, 32). The catch portion (30, 32) comprises a generally U-shaped adjustment element (30) formed of thermostatic material whose legs are fixed to the base (32*a*) of a catch member (32) which in turn is pivotably mounted in the casing of the circuit breaker. The bight (30*c*) of the adjustment element is free to move in response to temperature changes relative to the catch member. Overcurrent will cause the thermostatic trip member to transfer motion to the bight of the adjustment element causing the adjustment element and catch member to pivot and release a latch to thereby open the circuit breaker. According to a first embodiment, the thermostatic adjustment element (30) is oriented relative to the thermostatic trip member such that the two components move in opposite directions upon a change in temperature making the circuit breaker sensitive to changes in ambient temperature. A modified embodiment includes a stop member (48) to limit movement of the adjustment member in one direction to make the circuit breaker sensitive to ambient temperatures over one range of temperature and less sensitive over a second range of temperature. Another embodiment shows the adjustment element (30') separated at its bight (30*c'*) with each leg (30*a'*, 30*b'*) formed of selected material to provide various combinations of selected ambient sensitivity response to the circuit breaker.

5 Claims, 8 Drawing Sheets

CIRCUIT BREAKER HAVING SELECTED AMBIENT TEMPERATURE SENSITIVITY

CROSS-REFERENCE TO RELATED APPLICATIONS

This application contains subject matter also contained in copending Application Serial No. (A41241).

FIELD OF THE INVENTION

This invention relates generally to circuit breakers and more particularly to current responsive circuit breakers for interrupting electrical circuits on the occurrence of predetermined overload conditions in the circuits.

BACKGROUND OF THE INVENTION

Current responsive electrical circuit breakers typically interrupt electrical circuits in response to the occurrence of selected overload current conditions in the circuits to protect other equipment and wiring in the circuits from damage due to overheating or overcurrent or the like. In one particularly advantageous circuit breaker shown in U.S. Pat. No. 3,361,882 commonly assigned to the assignee of the present invention, the disclosure of which is included herein by this reference, an actuator mechanism manually moves movable contacts into and out of engagement with complementary stationary contacts to make and break a circuit. A current carrying thermostatic trip member is operable to break the circuit in response to the occurrence of a selected overload current in the circuit. The thermostatic trip member is a composite member having a metal layer formed of relatively higher coefficient of expansion and a co-extensive metal layer formed of relatively lower coefficient of expansion arranged so that the layer having the lower coefficient of expansion faces a motion transfer member which is slidably positioned between a portion of the thermostatic trip member which moves with changes in temperature of the thermostatic trip member and a catch assembly. The catch assembly includes a catch surface which interacts with a latch attached to the actuator mechanism. Upon overcurrent conditions the current carrying thermostatic trip member bends thereby moving the motion transfer member which in turn moves the catch assembly releasing the latch to allow the actuator mechanism to move the movable contact and break the circuit. The catch assembly includes a compensator formed of thermostatic material having a layer of relatively higher coefficient of expansion and a layer of relatively lower coefficient of expansion. The compensator is generally U-shaped, having first and second legs extending from a bight with the ends of the legs fixedly attached to a cross-bar of a T-shaped member which extends upwardly between the legs and with the top surface thereof serving as the catch for the latch of the actuator mechanism. The cross-bar is mounted for pivotal motion and is biased toward a normal operating position. The compensator is arranged so that the side having the higher coefficient of expansion faces the trip member. The bight of the U-shaped compensator which is aligned with the motion transfer member moves in the same direction that the trip member moves with changes in temperature to reduce the effect of ambient temperature changes, or in other words, to make the circuit breaker less sensitive to changes in ambient temperature. Thus, the distance between the trip member and the compensator at the location of the motion transfer member stays relatively constant with changes in ambient temperature however, as mentioned above, upon sufficient heating of the trip member due to overcurrent conditions, the trip member will bend toward the compensator causing the motion transfer member to move and the compensator to pivot along with the catch and thereby release the latch to break the circuit.

There are applications, however, in which there is a need to increase sensitivity to ambient temperature changes, at least over a selected range of ambient temperature.

SUMMARY OF THE INVENTION

It is an object of the present invention to provide a circuit breaker which has increased sensitivity to changes in ambient temperature. Another object of the invention is to provide a circuit breaker which has increased sensitivity to changes in ambient temperature at elevated temperatures and with higher trip temperatures and forces of the current carrying tip member. Still another object is the provision of a circuit breaker which has a lengthened overload trip time at room temperature. Another object of the invention is the provision of a circuit breaker in which the ultimate trip current is increased with a decrease in ambient temperature. Still another object of the invention is the provision of a circuit breaker in which one type of ambient temperature sensitivity can be selected over a first portion of a temperature range and a second, different type of sensitivity can be selected over a second portion of the temperature range.

Briefly, in accordance with a first embodiment of the invention, an ambient temperature adjustment member, formed of thermostatic material having a layer of relatively higher coefficient of expansion material and a layer of relatively lower coefficient of expansion material, is oriented so that it reacts to temperature in a direction that is opposite to the direction that a current carrying thermostatic trip member moves in reaction to changes in temperature thereby decreasing the distance between the trip member and the compensator when both are heated and making the circuit breaker sensitive to increases in ambient temperature. In a modified embodiment a compensator stop element is mounted in fixed relation to the catch and positioned to limit motion of the adjustment member at a selected location with decreasing ambient temperature thereby providing a circuit breaker which is sensitive to increased ambient temperature without decreasing the room temperature trip temperature of the trip member. In accordance with another embodiment of the invention, the adjustment member is separated at the bight and the first and second legs are formed of materials different from one another to provide various responses to changes in ambient temperature including ambient compensation and non-compensation of various degrees in two separate temperature ranges. The materials which can be used for the first and second legs include any desired combination of thermostatic members with more or less thermally responsive motion and with forward or reverse motion as well as thermostatic and non-thermostatic members.

BRIEF DESCRIPTION OF THE DRAWINGS

Other objects, advantageous and details of the thermally responsive overload circuit breaker of this invention appear in the following detailed description of the preferred embodiments of the invention, the detailed description referring to the drawings in which.

Figure 1:
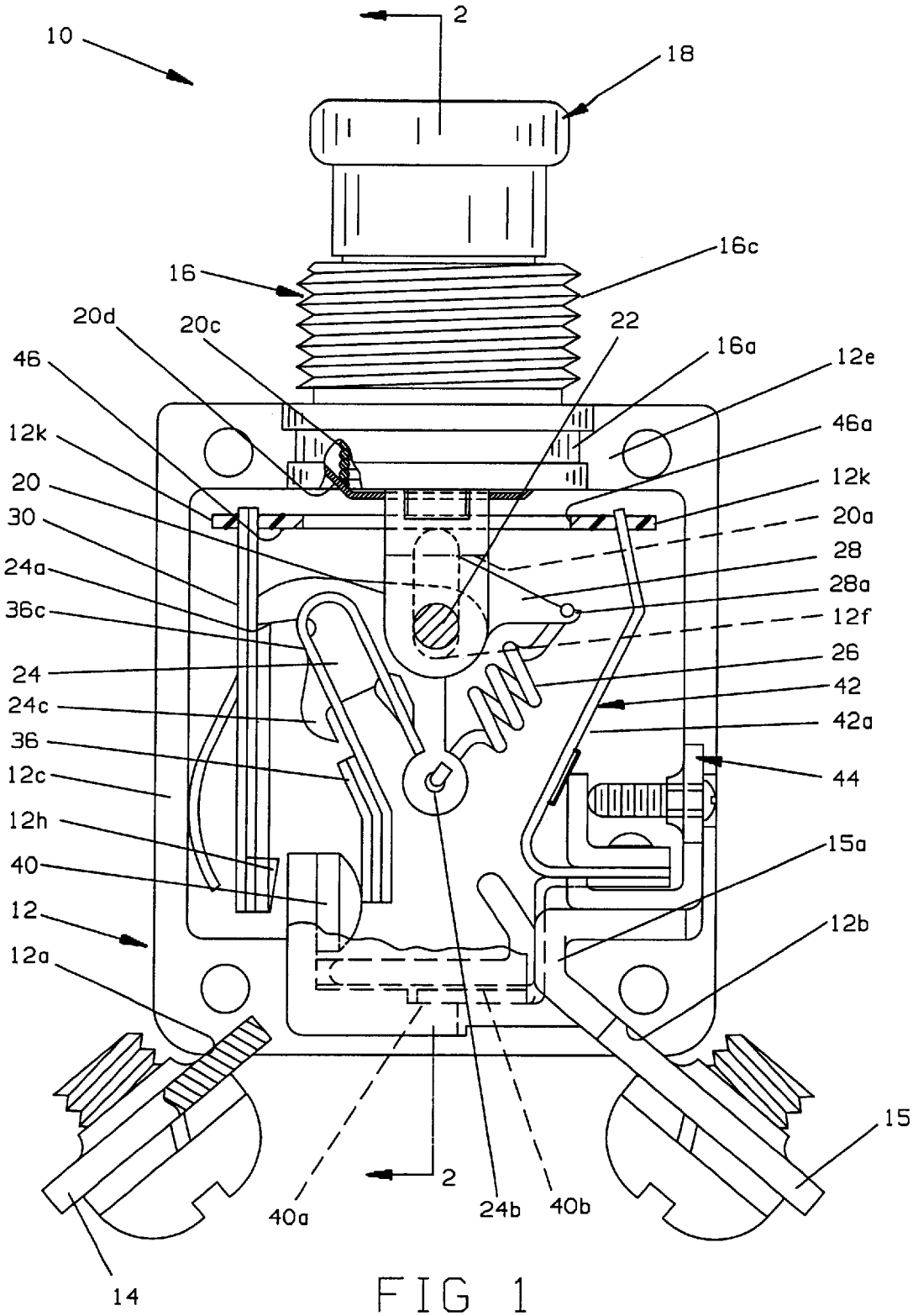
FIG. 1 is a front elevational view, partly in cross-section, of a circuit breaker made in accordance with a first embodiment of the invention but shown with the contacts in the engaged position.

Dimensions of certain of the parts as shown in the drawings may have been modified and/or exaggerated for the purposes of clarity of illustration.

DETAILED DESCRIPTION OF PREFERRED EMBODIMENTS

Referring to the drawings, and more particularly to FIGS. 1–4, circuit breaker 10 made in accordance with the invention includes a housing or casing 12 which may be made of suitable molded synthetic resin which is electrically insulating. At one end of the casing suitable slots 12*a* and 12*b* are provided for receiving the fixedly mounted terminal structures 14, 16. For ease of assembly of the circuit breaker casing 12 is shown composed of two mating halves, 12*c*, 12*d*.

At the end of the casing halves removed from the end having slots 12*a*, 12*b*, there is provided an inwardly projecting shoulder 12*e* which is received in an annular groove 16*a* of a bushing of suitable material such as steel to hold the bushing securely to the casing. Flat portions (not shown) preferably are formed on a shoulder 16*b* of the bushing and a mating portion of casing 12 to prevent rotation of the bushing in casing 12.

Bushing 16 serves to mount the circuit breaker in a panel or the like by means of threaded portion 16*c* as well as to mount internally an actuator and latch assembly including a push button 18. Latch plunger 20 is slidably mounted in bushing 16 and is provided at its lower end with a slot 20*a* and a yoke 20*b*. A bell crank type latch 24 is rotatably mounted in slot 20*a* by means of a transversely extending pin 22 received through a suitable hole in latch 24 and with the ends of the pin in turn slidably received in slots 12*f*, 12*g* of casing halves 12*c*, 12*d*, respectively.

Bell crank latch 24 is formed with a laterally extending lip portion 24*a* and, angularly removed from portion 24*a*, a leg 24*b* provided with a suitable hole for engaging one end of a tension spring 26, the other end of spring 26 being attached to an extending finger 28*a* of an anchor plate 28. Plate 28 is held in slot 20*a* by means of the aforesaid pin 22 which passes through a hole formed in plate 28. Plate 28 is formed with a flat upper side which abuts the end of slot 20*a* thereby preventing rotation about pin 22. Thus, bell crank latch 24 is provided with a counterclockwise bias about pin 22 by means of spring 26.

Figure 5:
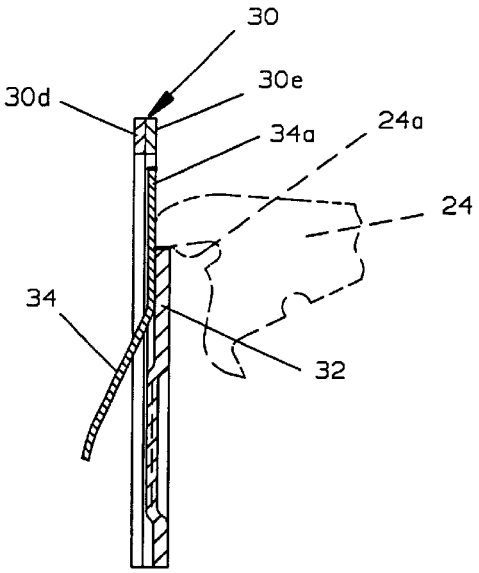
FIG. 5 is a front elevational view, in cross section, of the ambient temperature adjustment assembly of the FIG. 1 embodiment.
Figure 6:
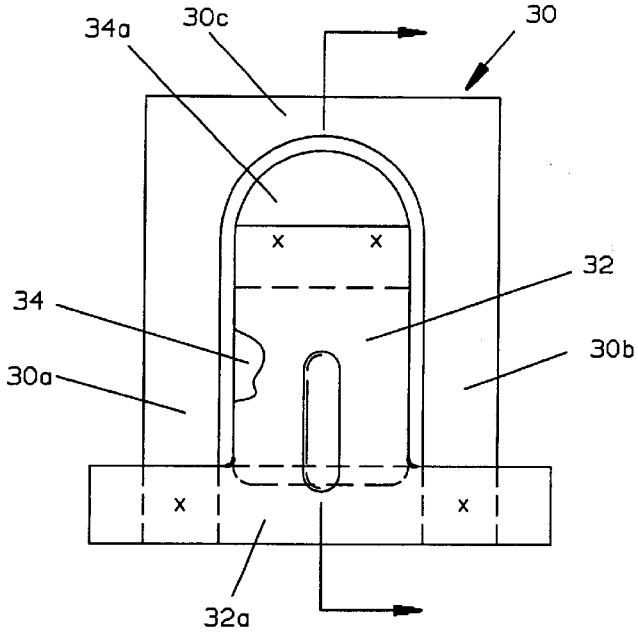
FIG. 6 is a side elevational view of the FIG. 5 adjustment assembly.

With particular reference to FIGS. 5 and 6, a catch assembly is shown including a catch member 32, the purpose of which is to releasably engage the latch part 24*a* on bell crank latch 24, and an adjustment element 30 to act as an ambient temperature adjustment mechanism for the thermostatically operated portion of the circuit breaker. Adjustment element 30 is generally U-shaped and has legs 30*a*, 30*b*. The catch member 32 is generally T-shaped having at one end a cross-bar 32*a* to which the ends of legs 30*a*, 30*b* are fixedly attached, as by welding. A leaf spring 34 is fixedly secured to the top portion of catch member 32 and may, if desired, project somewhat above the end of the catch as shown at 34*a*. Portion 34*a* serves as a back-stop for the latch part 24*a* of the bell crank latch to prevent over-riding of the catch member.

Adjustment element 30 is comprised of thermostatic material, e.g., bimetal, and in view of the fact that element 30 is fastened to the catch member only at the ends of legs 30*a*, 30*b*, it will be seen that as the temperature of element 30 changes it can bend or curve by itself without affecting the position of the catch member 32. As shown, the high expansion layer 30*d* (higher coefficient of expansion) is to the left as drawn, and the low expansion layer 30*e* (lower coefficient of expansion) is to the right. Thus, when adjustment element 30 is heated by the surrounding ambient it will flex or bend to the right, as drawn.

The assembly comprising bimetal adjusting element 30, together with its associated catch member 32 and biasing spring 34, is pivotably mounted with cross-bar 32*a* received in a pair of slots 12*h* molded in the walls of the casing halves 12*c*, 12*d* and with spring 34 bearing against the sidewall of the casing and biasing the adjustment assembly clockwise, as drawn, about its pivot point in slots 12*h*.

Figure 2:
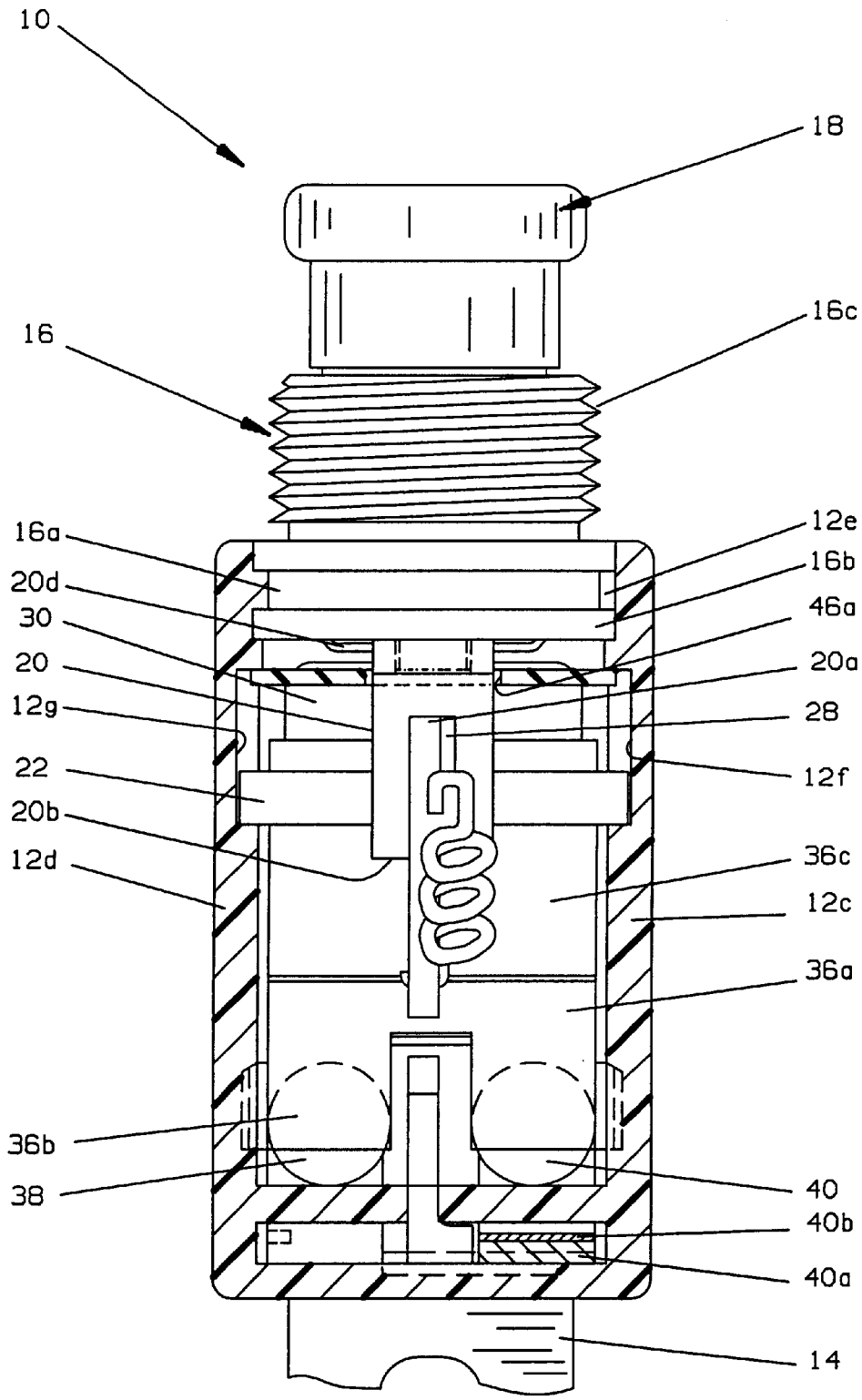
FIG. 2 is a side elevational view, partly in cross-section of the FIG. 1 embodiment with the contacts in the engaged position.

With reference to FIGS. 1 and 2, movable contact 36 is a bridging contact bifurcated to form first and second contact portions 36*a*, 36*b*, respectively. Contact 36 is mounted on leaf spring 36*c* having a return bend portion the free end of which is engaged with shoulder 24*b* while motion in the opposite side of the spring, adjacent to the contact portion, is limited by hook 24*c* of bell crank latch 24.

Stationary contacts 38, 40, are fixedly mounted in casing 12. Contact 38 is mounted on an extension of terminal 14 by suitable fastening means such as welding or soldering, the structure being held in the casing in slot 12*a*. Contact 40 is mounted on a metal support 40*a* which in turn is electrically connected to an electrical connecting strap 40*b* whose other end is connected to the distal end of a leg 42*a* of a thermostatic trip member 42. Contacts 38 and 40 are electrically separated and are adapted to be bridged by the bridging movable contact 36 when contact 36 is in engagement therewith.

Figure 7:
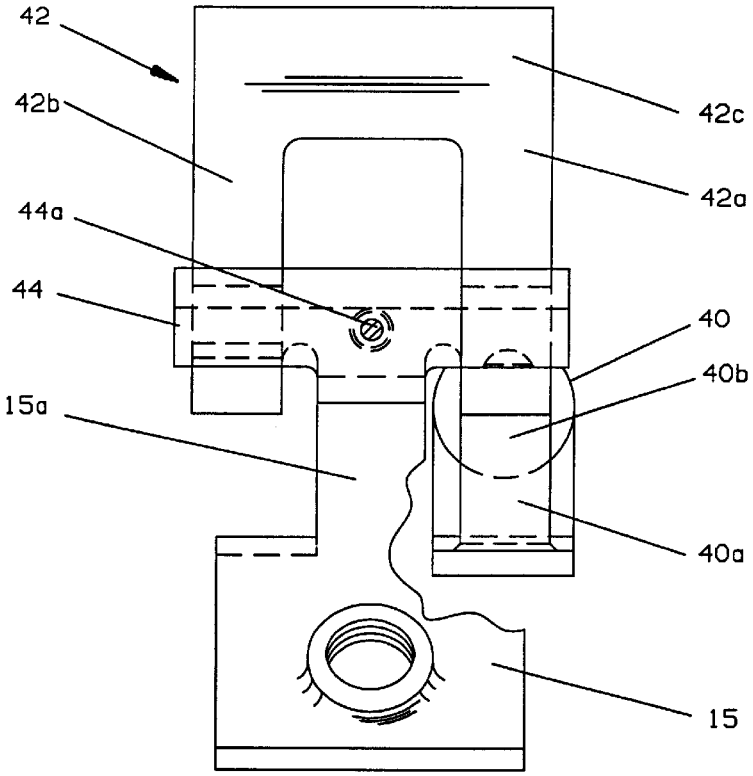
FIG. 7 is a side elevational view of the thermostatic trip member and associated parts.

Thermostatic trip member 42, best seen in FIG. 7, is generally U-shaped having legs 42*a*, 42*b* extending from a bight portion 42*c*. The distal ends of the legs 42*a*, 42*b* are mounted on channel like support 44 which is electrically connected to an extension 15*a* of terminal 15 received in slot 12*b* of the casing. The distal end of leg 42*a* is electrically separated from support 44 by suitable electrically insulating material placed therebetween while the distal end of leg 42*b* is electrically connected to support 44. Thus, an electrical path runs from terminal 15 to support 44, leg 42*b* of trip member 42 through leg 42*a* to strap 40*b*, support 40*a* and contact 40. As drawn, the high expansion side of thermostatic trip member 42 lies on the right and the low expansion side on the left. The calibrating screw 44*a* is threadingly received in a threaded hole in the channel like support which, when turned, can be used to spread the sidewalls of the channel apart or permit the walls to approach one another thereby causing bight portion 42*c* to move toward or away from the bimetal adjustment element 30.

A pair of slots 12*k* are provided in two opposing walls of casing 12 and slidably receive therein the edges of motion transfer slide member 46. Slide member 46 is a generally rectangularly shaped piece of electrically insulative material and is used to transmit motion from thermostatic trip member 42 to the adjustment element 30, and catch member 32. Slide member 46 is formed with a suitably shaped and dimensioned aperture 46*a* for receiving latch plunger 20.

Thus, electric current passing through the circuit breaker passes through thermostatic trip member 42; however, the adjustment element 30 receives no electrical current and therefore derives its temperature change, if any, because of the temperature of the ambient air surrounding it, by radiation from the casing and/or conduction from heated portions of the circuit breaker.

Figure 3:
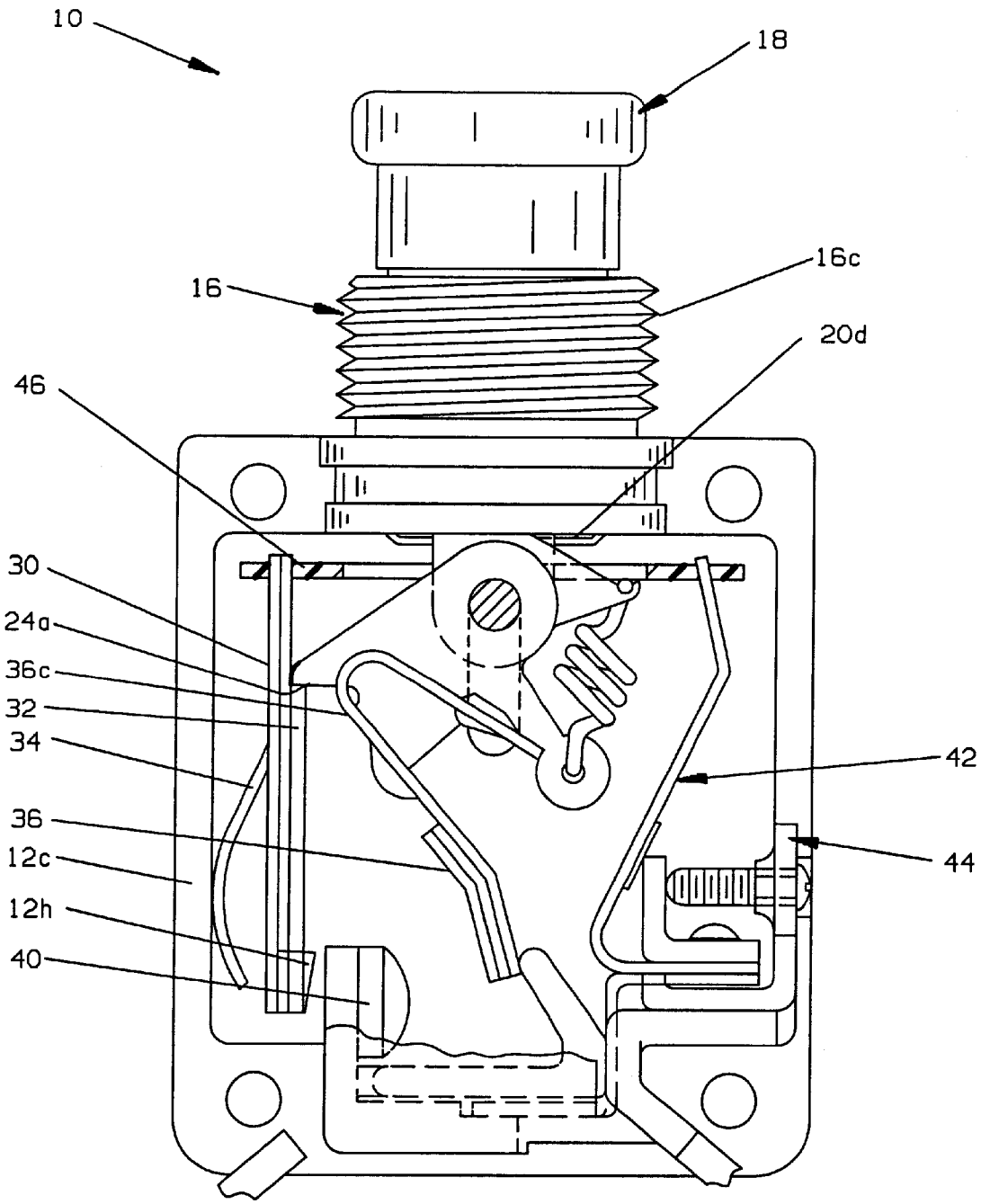
FIG. 3 is a view similar to FIG. 1 but shown with the contacts in the disengaged position.
Figure 4:
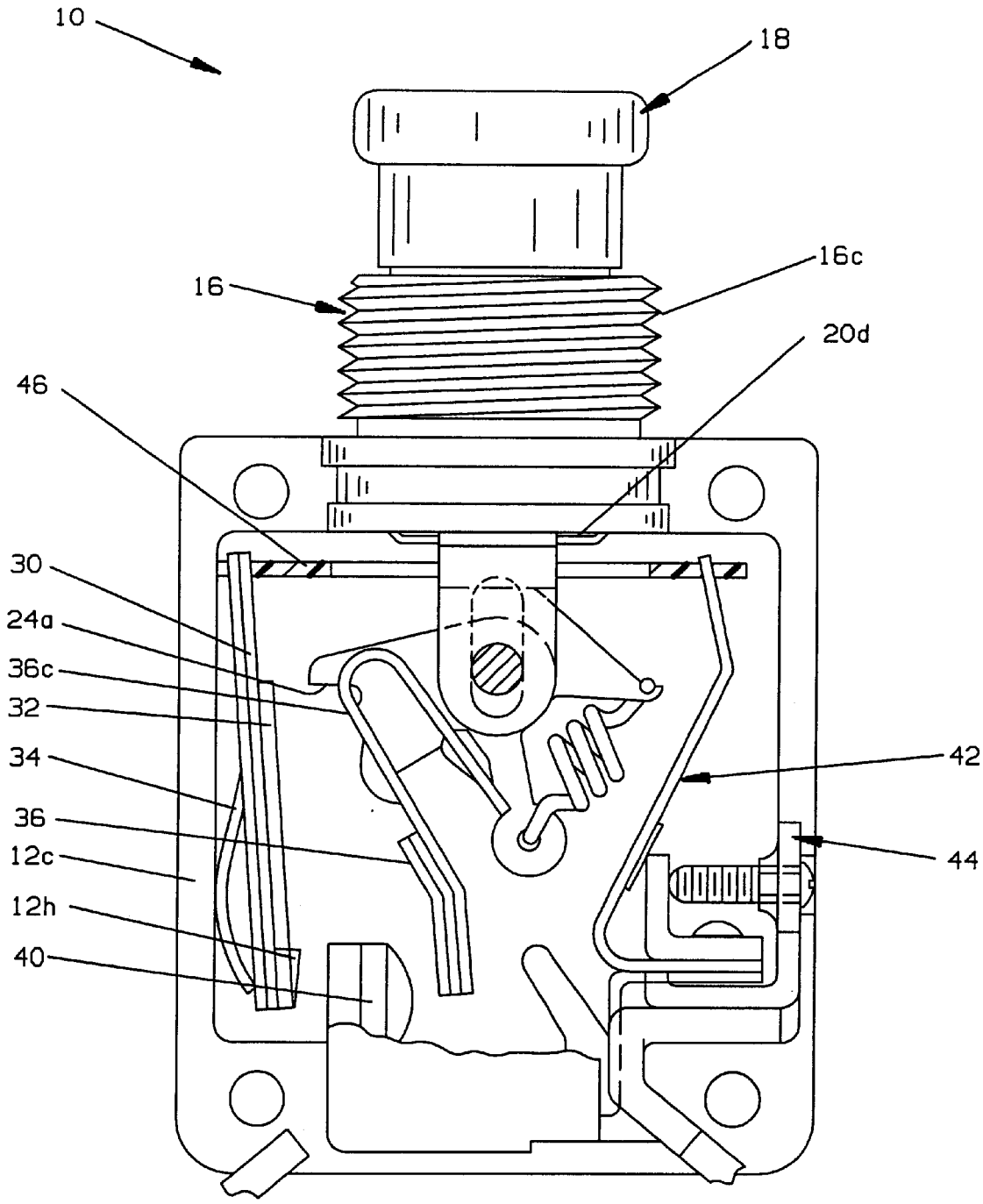
FIG. 4 is a view similar to FIG. 1 shown with the movable parts thereof in an intermediate position.

FIG. 1 shows circuit breaker 10 with plunger 20 pushed inwardly into casing 12 and maintained in that position by a mechanical latching mechanism (not shown) within bushing 16 and with lip portion 24*a* of bell crank latch 24 caught by catch member 32 and the bell crank latch rotated clockwise about pin 22 and against the pull of tension spring 26 and with movable contact 36 in engagement with and bridging stationary contacts 38 and 40. When an overload current flows through the circuit breaker, thermostatic trip member 42 will heat up because of the current passing through it and will bend to the left, as shown in the drawing. As it bends to the left, it will force slide 46 to move transferring the motion of thermostatic trip member 42 to the adjustment element 30 of the catch assembly. Motion of the thermostatic trip member 42 will move the adjustment element 30 to the left along with catch member 32 until lip portion 24*a* of bell crank latch 24 escapes the catch member. The mechanical latch of plunger 20 is then released and the plunger assembly moves upwardly under the influence of a coil spring 20*c* mounted within bushing 16 and reacting against a cup-shaped washer 20*d* (only the bottom portion of spring 20*c* being shown in FIG. 1 of the drawings). The upward motion of pin 22 together with the pull of tension spring 26 rotates bell crank 24 counter-clockwise about pin 22 to pull movable contact 36 away from stationary contacts 38 and 40, thus breaking the electrical circuit through the circuit breaker. FIG. 4 shows the circuit breaker with its components in an intermediate position just after unlatching caused by current flow through the thermostatic trip member 42 while FIG. 3 shows the circuit breaker in the complete contacts disengaged or open position after thermostatic trip member 42 has cooled ready for movement of pushbutton 18 and plunger 20 inwardly to movable contact 36 in engagement with stationary contacts 38 and 40 in the closed position. Further details of the operating mechanism can be obtained from the above referenced U.S. Pat. No. 3,361,882.

Figure 10:
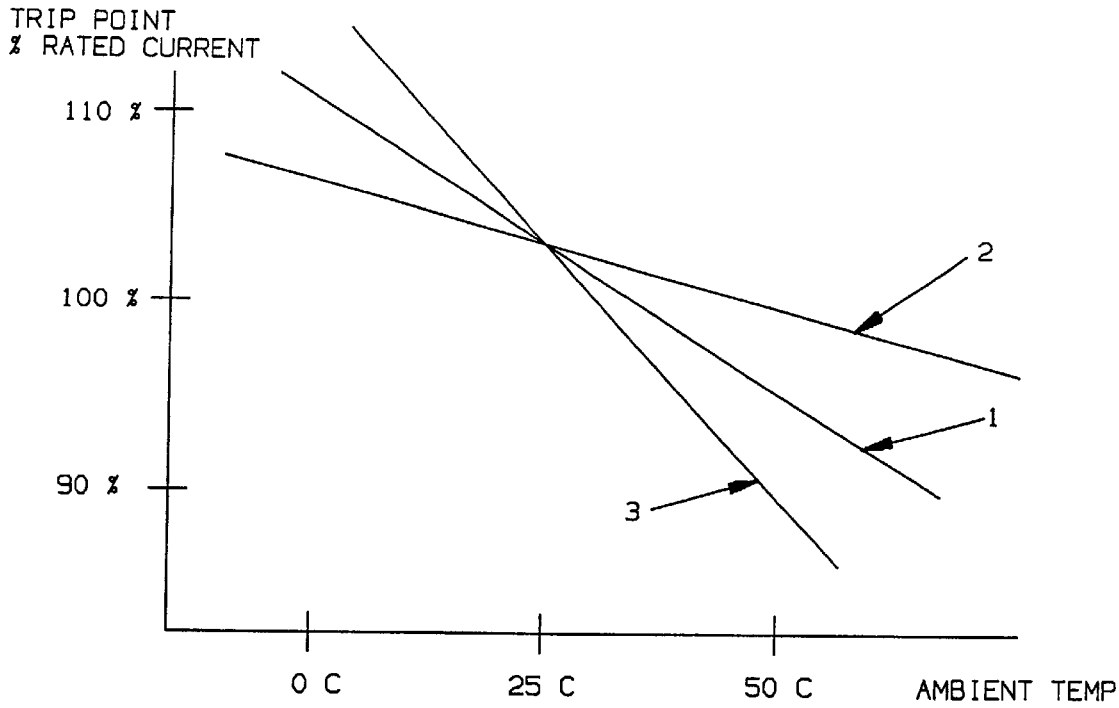
FIGS. 10–13 are graphs showing the trip point in percent of rated current vs. ambient temperature for circuit breakers having different ambient temperature adjustment assemblies.

In accordance with the present invention, adjustment element 30 of the ambient temperature adjustment mechanism is arranged so that its low expansion side 30*e* faces to the right and its high expansion side 30*d* faces to the left as shown in FIG. 1. This arrangement results in making the circuit breaker more sensitive to ambient temperature, desired for certain applications, for example where the circuit breaker and wiring to be protected are disposed in the same ambient, without the adverse affects of decreasing the room temperature trip temperature of the thermostatic trip member. That is, since a given amount of work is required to overcome friction between the bell crank lip and the catch, as the trip temperature is lowered less useful work is available. With reference to FIG. 10, a graph is shown of trip point as a percent of rated current vs. ambient temperature of circuit breakers calibrated to trip at a selected current level at room temperature (25° C.). Numeral 1 reflects the results on the trip point with changes in ambient temperature of a circuit breaker of the type described which has no ambient compensation, that is, one in which adjusting element 30 is composed of non-thermostatic material such as stainless steel. Numeral 2 reflects the results of a circuit breaker having ambient compensation as shown and described in U.S. Pat. No. 3,361,882, referenced above resulting in a smaller change in trip current for the same change in ambient temperature and numeral 3 reflects the result of a circuit breaker made in accordance with the first embodiment of the invention with the adjusting element 30 having the high and low sides of expansion reversed relative to that taught in the above referenced patent. It will be seen that the slope of line 3 of the circuit breaker made according to the invention is steeper than that of a non-compensated circuit breaker resulting in a larger change in trip current for the same change in ambient temperature. The slope of line 2 of the ambient compensated circuit breaker is shallower than that of the non-compensated circuit breaker. The present invention permits the use of a higher temperature trip member 42 making operation of the circuit breaker more consistent or repeatable since friction is variable from one trip to another and the higher temperature trip member provides more work output with a smaller portion of the work going to overcome friction.

An additional benefit derived from the invention relates to the fact that for a selected circuit breaker rating it takes more time for the device to trip on a given overload. Conventionally, it would be necessary to increase the mass of the trip member to accomplish this which results in less work output per unit of mass as well as adding to the expense of the circuit breaker. By reversing the orientation of the thermostatic trip member, a longer trip time is obtained due to increased movement of the trip member. That is, during a steady state condition the trip member heats to a certain temperature and some heat is transferred over to the adjustment member, the two components moving toward each other so that the trip member is required to move a longer distance in order to trip the device.

Figure 8:
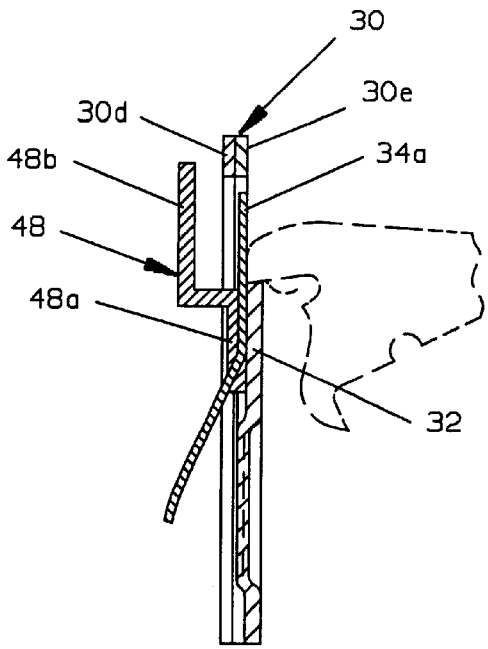
FIG. 8 is a front elevational view similar to FIG. 5 but showing an optional modification of the FIG. 1 embodiment.
Figure 11:
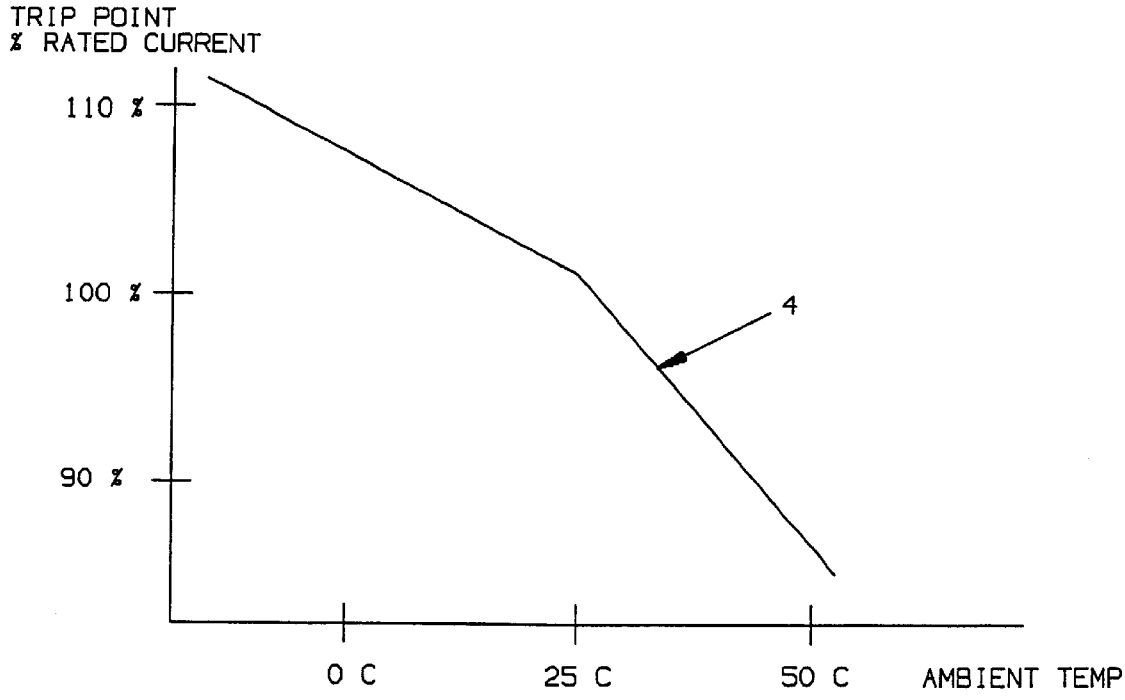

According to a modification of the first embodiment, as seen in FIG. 8, a stop member 48 has a base portion 48*a* fixedly attached to catch member 32 and is formed with an offset leg portion 48*b* which extends upwardly into alignment with the bight portion 30*c* of the adjustment member and spaced a selected distance therefrom at a selected temperature so that movement of adjustment member 30 is limited to a fixed location with lower ambient temperatures. This provides a circuit breaker which is sensitive to ambient temperature changes as the ambient temperature increases but is less sensitive as ambient temperatures decrease as shown by line 4 of FIG. 11.

Figure 9:
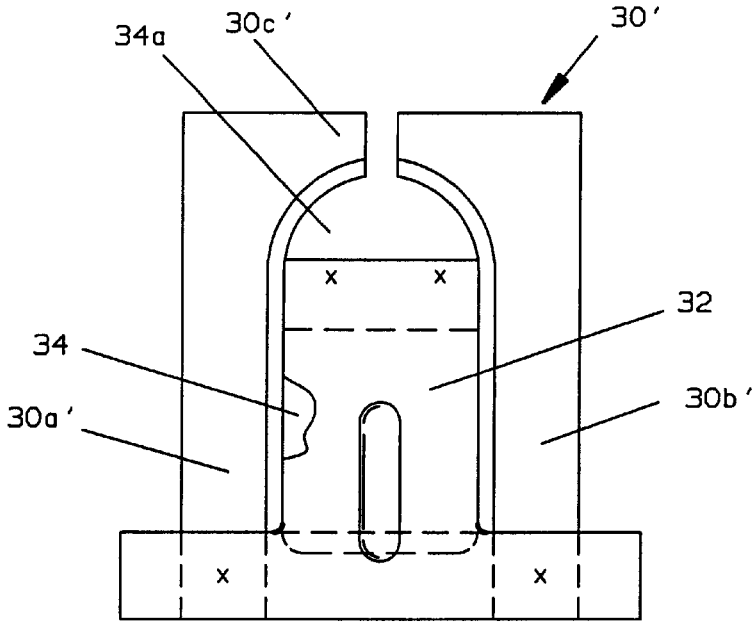
FIG. 9 is a front elevational view similar to FIG. 6 of an adjustment assembly made in accordance with another embodiment of the invention.
Figure 12:
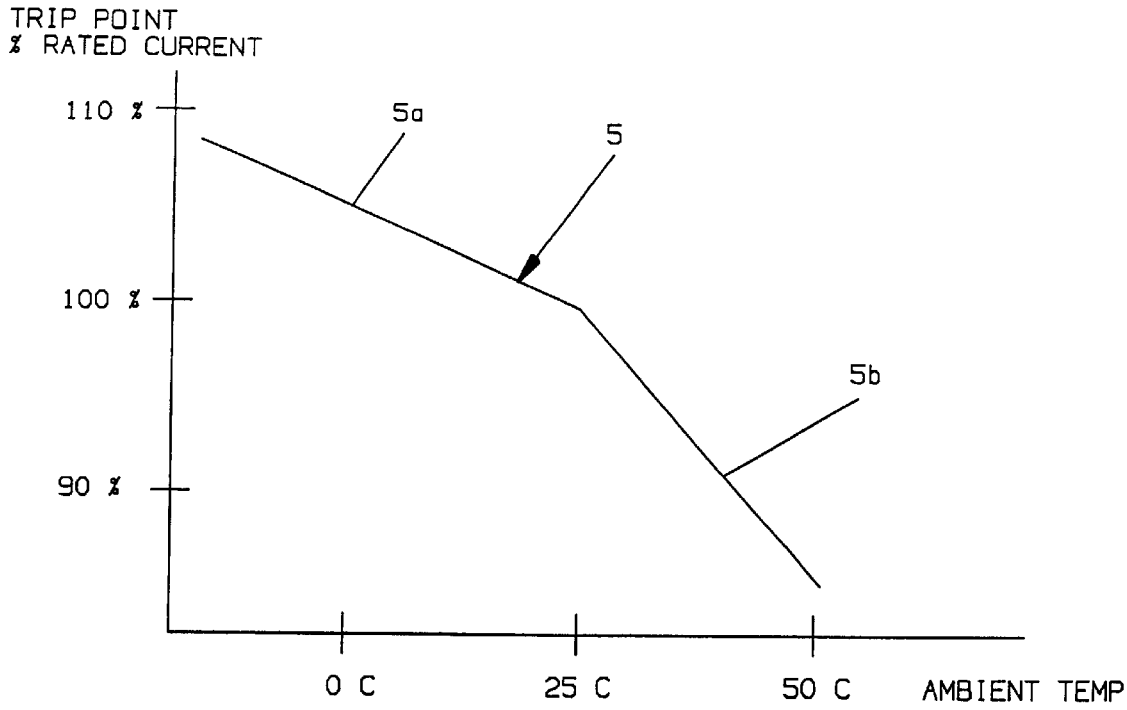
Figure 13:
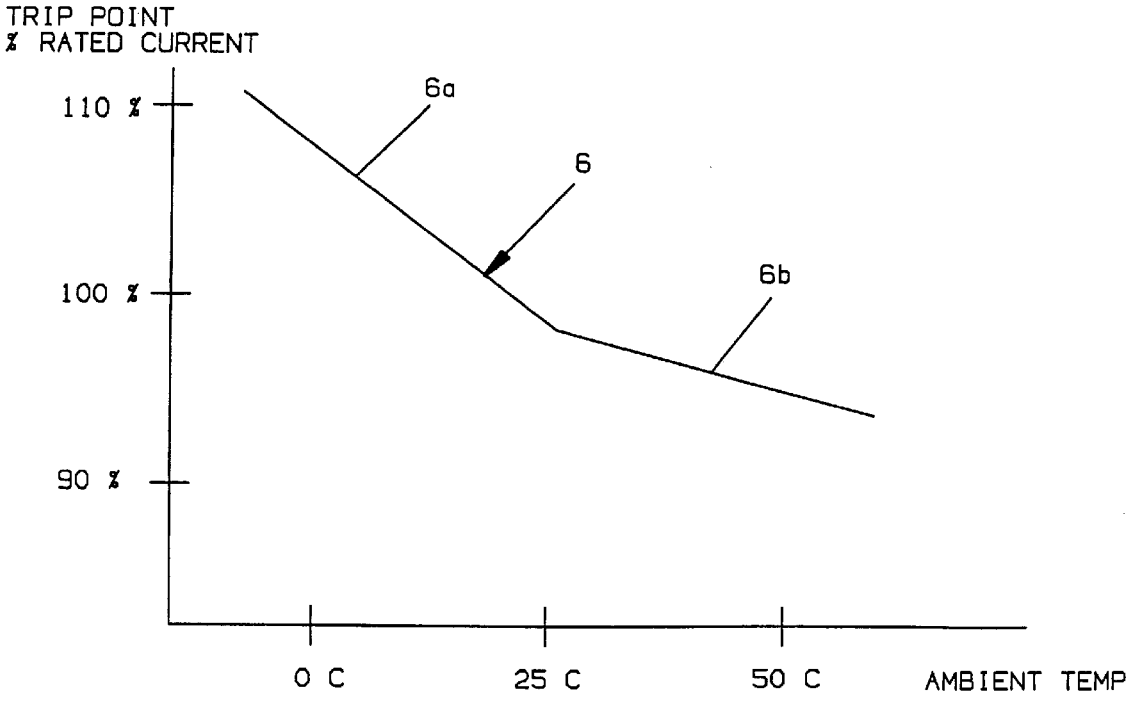

FIG. 9 shows another embodiment of the invention in which the adjustment element 30' comprises first and second legs 30*a*', 30*b*' which are separated from one another, i.e., at bight or upper end 30*c*'. This structure allows the tailoring of adjustment member 30' to meet a number of different specifications relative to compensation for ambient temperature changes. Thus, the legs can be composed of the same thermostatic material so that in one leg the thermostatic member has a forward orientation (high side of expansion facing the trip member) and the other has a reverse orientation (high side of expansion facing away from trip member). Alternatively, the legs can be composed of thermostatic material, in either orientation, which have relatively more or less thermal activity. Still another option is to form one of the legs from non-thermostatic material such as stainless steel. FIGS. 12 and 13 are graphs showing the results of two examples of circuit breakers employing the adjustment element of FIG. 9. Thus, line 5 of FIG. 12 includes portion 5*a* having a more active forward compensated leg and 5*b* a less active reverse compensated leg while line 6 of FIG. 13 includes portion 6*a* which shows a non-compensated leg while line 6*b* shows a less active forward compensated leg.

Below is a table of fifteen variations of adjustment member 30' providing different ambient temperature response of the circuit breaker.

TABLE

| | | |
|---|---|---|
| Possible metals | Hot order of precedence | More active reverse/less active reverse/S.S./less active forward/more active forward |
| More active forward | Cold order of precedence | More active forward/less active forward/S.S/less active reverse/more active reverse |
| Less active forward | | |
| More active reverse | | |
| Less active reverse | | |
| Stainless steel | | |

| Composition | | Behavior | | |
|---|---|---|---|---|
| Leg 30a' | Leg 30b' | Hot | Cold | Notes |
| More active forward | More active forward | More active forward | More active forward | Same as element 30 more active forward |
| More active forward | Less active forward | Less active forward | More active forward | |
| More active forward | More active reverse | More active reverse | More active forward | |
| More active forward | Less active reverse | Less active reverse | More active forward | |
| More active forward | Stainless steel | Non-compensated | More active forward | |
| Less active forward | Less active forward | Less active forward | Less active forward | Same as element 30 less active forward |
| Less active forward | More active reverse | More active reverse | Less active forward | |
| Less active forward | Less active reverse | Less active reverse | Less active forward | |
| Less active forward | Stainless steel | Non-compensated | Less active forward | |
| More active reverse | More active reverse | More active reverse | More active reverse | Same as element 30 less active reverse |
| More active reverse | Less active reverse | More active reverse | Less active reverse | |
| More active reverse | Stainless steel | | | |
| Less active reverse | Less active reverse | Less active reverse | Less active reverse | Same as element 30 less active reverse |
| Less active reverse | Stainless steel | Less active reverse | Non-compensated | |
| Stainless steel | Stainless steel | Non-compensated | Non-compensated | Same as element 30 S.S. |

The points at which the devices change from one compensation curve to the other can be adjusted by varying the positions of the two legs with respect to each other and to catch member 32.

In view of the above, it will be seen that the several objects of the instant invention are achieved and otherwise unique and advantageous results attained.

As many changes could be made in the above constructions without departing from the scope of the invention, it is intended that all matter contained in the above description or shown in the accompanying drawings, shall be interpreted as illustrative and not in a limiting sense, and it is also intended that the appended claims shall cover all such equivalent variations as come within the scope of the invention.

What is claimed:

1. An electrical circuit switching device comprising a casing, an actuator mounted on the casing and movable with respect thereto, an electric circuit including at least one first contact mounted in the casing, a current responsive thermostat member mounted in the casing and having at least a portion thereof movable in response to selected current levels, an adjustment element having first and second ends and being pivotably mounted at the first end thereof in the casing with the second end being free for movement, the adjustment element having at least two layers of metal with different thermal coefficients of expansion, the adjustment element arranged so that the layer having the lower coefficient of expansion faces toward the current responsive thermostat member, a motion transfer member coupled to the movable portion of the current responsive thermostat member and the movable second end of the adjustment element, a catch operatively associated with the adjustment element and movable thereby upon movement of the current responsive thermostat member, the catch comprising a member having first and second ends and being attached at the first end to the adjustment element adjacent the pivotable first end thereof but the remaining length of the catch being free of the adjustment element and having the remaining length of the catch out of alignment with the adjustment element so that the adjustment element can bend under the influence of temperature without moving the free end of the catch, a latch connected to the actuator and adapted to cooperate with the catch, at least one movable contact operated by the latch to engage and disengage the first contact to make and break the electrical circuit therethrough upon movement of the latch, the electrical circuit including the current responsive thermostat member, the movable second end of the adjustment element being movable in the opposite direction relative to the movable portion of the current responsive thermostat member under the influence of a change in temperature of both the current responsive thermostat member and the adjustment element to provide increased sensitivity to ambient temperature conditions.

2. An electrical circuit switching device according to claim 1 further comprising a stop member having a portion aligned with the second end of the adjustment element and spaced a selected distance from the catch in a selected direction to limit movement of the adjustment element in the selected direction.

3. An electrical circuit switching device according to claim 2 in which the stop is attached to the catch.

4. A switching device according to claim 1 in which the adjustment element is generally U-shaped having first and second legs with distal end portions which form the pivotably mounted first end and with the catch disposed between the first and second legs.

5. An electrical switching element according to claim 4 in which the catch is generally T-shaped having a cross-bar with a leg extending upwardly from the cross-bar, the cross-bar being fixedly attached to the distal end portion of the first and second legs of the adjustment element.

* * * * *